US009376241B2

(12) United States Patent
Heipp et al.

(10) Patent No.: US 9,376,241 B2
(45) Date of Patent: Jun. 28, 2016

(54) CLOG-RESISTANT CLOSURES FOR ADHESIVE CONTAINERS

(71) Applicant: Elmer's Products, Inc., Westerville, OH (US)

(72) Inventors: Shawn D. Heipp, Columbus, OH (US); Louis A. Farchione, III, Columbus, OH (US)

(73) Assignee: Elmer's Products, Inc., Atlanta, GA (US)

( * ) Notice: Subject to any disclaimer, the term of this patent is extended or adjusted under 35 U.S.C. 154(b) by 91 days.

(21) Appl. No.: 14/464,317

(22) Filed: Aug. 20, 2014

(65) Prior Publication Data

US 2015/0053726 A1 Feb. 26, 2015

Related U.S. Application Data

(60) Provisional application No. 61/867,668, filed on Aug. 20, 2013.

(51) Int. Cl.
*B65D 35/38* (2006.01)
*B65D 47/20* (2006.01)

(52) U.S. Cl.
CPC ..... *B65D 47/2031* (2013.01)

(58) Field of Classification Search
CPC ..... B65D 47/2031
USPC ..... 222/490, 494, 209, 212, 213, 207, 422
See application file for complete search history.

(56) References Cited

U.S. PATENT DOCUMENTS

| | | | | | |
|---|---|---|---|---|---|
| 2,135,237 | A * | 11/1938 | Lewis | B65D 47/2037 | 138/89.3 |
| 3,773,233 | A * | 11/1973 | Souza | B65D 47/2031 | 222/490 |
| 4,222,504 | A * | 9/1980 | Ackerman | B65D 23/065 | 222/569 |
| 5,033,655 | A * | 7/1991 | Brown | B29C 65/568 | 222/212 |
| 6,325,253 | B1 * | 12/2001 | Robinson | B65D 47/2081 | 222/212 |
| 6,402,841 | B1 * | 6/2002 | Vesterlund | B05D 1/26 | 118/315 |
| 7,086,572 | B2 * | 8/2006 | Socier | B65D 47/2031 | 222/494 |
| 8,016,507 | B2 * | 9/2011 | Wright | B65D 47/2031 | 401/266 |

* cited by examiner

*Primary Examiner* — Donnell Long
(74) *Attorney, Agent, or Firm* — Sutherland Asbill & Brennan LLP

(57) ABSTRACT

A closure for a glue bottle including a cap having a body and a tip, wherein the body is adapted to be attached to a bottle or container, and wherein the bottle or container is adapted to store water-based glue; and an insert disposed at least partially within the tip of the cap, wherein the insert further includes a one-way valve for dispensing glue from the bottle or container when pressure is applied to the exterior of the container and preventing backflow of the glue into the cap when the pressure is released; at least one hydrophobic material; wherein the at least one hydrophobic material is operative to encourage the water-based glue to flow back into the container after the pressure has been released and when the container is stored in a vertical position.

20 Claims, 4 Drawing Sheets

CLOG-RESISTANT CLOSURES FOR ADHESIVE CONTAINERS

CROSS-REFERENCE TO RELATED APPLICATIONS

This patent application claims the benefit of U.S. Provisional Patent Application Ser. No. 61/687,668, filed on Aug. 20, 2013 and entitled "No Clog Cap for Glue Bottles," the disclosure of which is incorporated by reference herein in its entirety and made part of the present U.S. utility patent application for all purposes.

BACKGROUND OF THE INVENTION

The described invention relates in general to a closure for bottles and other containers or vessels, and more specifically to a cap or closure for an adhesive container or glue bottle that reduces or eliminates clogging or fouling of the dispenser mechanism within the cap or closure.

Various users of commercially available glue and other adhesive (e.g., do-it-yourself or DIY users, woodworkers, teachers, children and parents, homeowners, crafters, artists, etc.) frequently encounter containers or dispensers, the caps or stems of which are clogged with dried glue or adhesive. Wood and/or paper glue and most other adhesives cannot be effectively dispensed from a container if the fluid channel within the container is clogged with dried glue or otherwise fouled. Therefore, consumers of such products often resort to removing clogged caps or closures in an effort to clean out dried glue, and if this is not possible or if the cap or closure is damaged in the cleaning process, the glue product may be disposed of entirely and perhaps not repurchased.

Certain known closure designs utilize a separate steel pin or molded-in plastic pin/tab for clearing excess or dried glue from a dispenser and to help seal the dispenser in a closed position (see, for example, the prior art device shown in FIG. 1). This design can be effective, but it relies on the consumer properly replacing and tightening the closure after the product has been used. If the closure has not been replaced and tightened properly, increased blockage due to dried glue or accidental spillage may results. Also, the pin and tab design still allows for residual glue to remain in the dispenser and dry out, thereby locking the closure in a closed position and preventing the consumer from being able to remove the closure. Thus, there is an ongoing need for a cap or closure for a glue or adhesive bottle that reduces or eliminates clogging or fouling of the dispenser mechanism or fluid channel within the cap or closure.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a first closure for glue bottles is provided. This closure includes a cap having a body and a tip, wherein the body is adapted to be attached to a bottle or container, and wherein the bottle or container is adapted to store water-based glue; and an insert disposed at least partially within the tip of the cap. The insert further includes: a one-way valve for dispensing glue from the bottle or container when pressure is applied to the exterior of the container and preventing backflow of the glue into the cap when the pressure is released; at least one hydrophobic material; wherein the at least one hydrophobic material is operative to encourage the water-based glue to flow back into the container after the pressure has been released and when the container is stored in a vertical position.

In accordance with another aspect of the present invention, a second closure for glue bottles is provided. This closure includes a cap having a body and a tip, wherein the body is adapted to be attached to a bottle or container, and wherein the bottle or container is adapted to store water-based glue; and an insert disposed at least partially within the tip of the cap. The insert further includes a one-way valve for dispensing glue from the bottle or container when pressure is applied to the exterior of the container and preventing backflow of the glue into the cap when the pressure is released; At least one hydrophobic material, wherein the at least one hydrophobic material further includes silicone; and wherein the silicone is operative to encourage the water-based glue to flow back into the container after the pressure has been released and when the container is stored in a vertical position.

In yet another aspect of this invention, a third closure for glue bottles is provided. This closure includes a cap having a body and a tip, wherein the body is adapted to be attached to a bottle or container, and wherein the bottle or container is adapted to store water-based glue; a valve for dispensing glue from the bottle or container when pressure is applied to the exterior of the container; at least one hydrophobic material, wherein the at least one hydrophobic material has been sprayed onto the inner surface the tip, the inner surface of the valve, or a combination thereof; and wherein the hydrophobic material is operative to encourage the water-based glue to flow back into the container after the pressure has been released and when the container is stored in a vertical position.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein:

FIG. 1 is an illustration of a prior art closure for a glue bottle or the like;

DETAILED DESCRIPTION OF THE INVENTION

Exemplary embodiments of the present invention are described below. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

Figure 1:
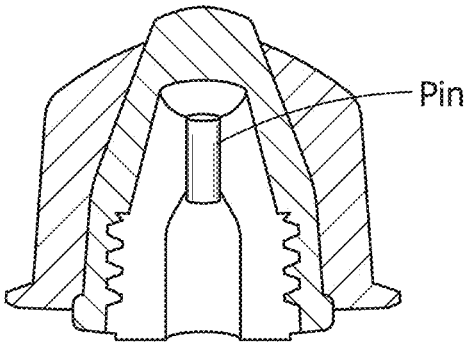
FIG. 1 (prior art)
Figure 2:
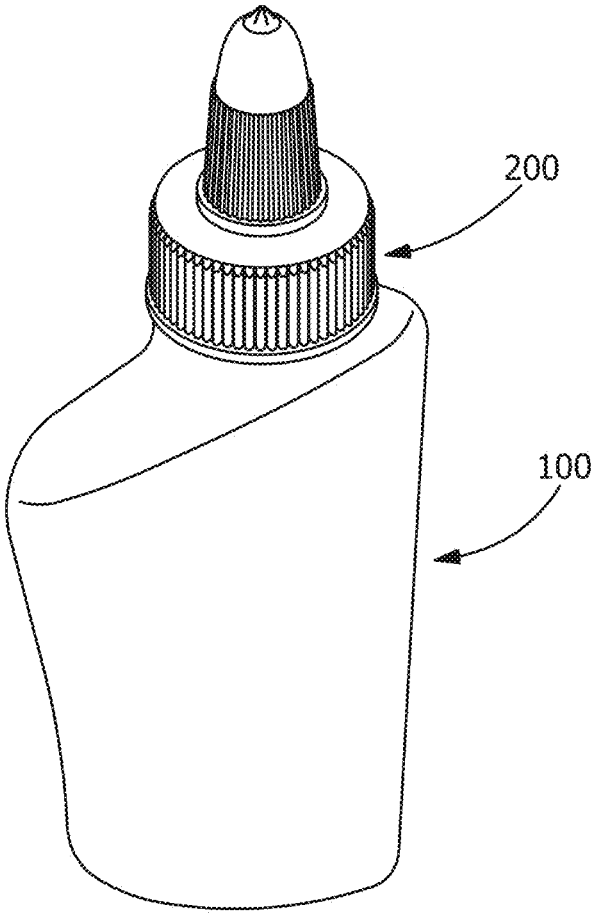
FIG. 2 is an illustration of an exemplary bottle or containment vessel for glue or adhesive, wherein the closure included on the bottle is similar to an exemplary embodiment of the present invention.

As previously indicated, the present invention provides a no-clog closure or cap that features an auto-close tip that promotes the flow of remaining glue back into a glue bottle to which the cap is attached. The cap achieves this through the use of a silicone liner or insert inside an injection molded plastic cap. The silicone (or material with properties similar to silicone) insert includes a one-way valve design at the tip that provides the auto-close functionality. When a consumer squeezes the bottle and applies pressure thereto, the valve opens and dispenses the adhesive. Once the consumer releases, the pressure is reduced/removed and the valve shuts and closes/seals off the bottle at the tip. There may be additional adhesive leftover inside the tip and this is where the other portion of the silicone insert becomes operative, acting as a silicone lining on the inside of the cap. The silicone lining is hydrophobic and therefore the waterborne adhesive naturally moves away from the silicone liner, thus draining back into bottle when placed in its vertical storage position. With reference now to the Figures, FIG. 1 provides a generalized drawing of a prior art closure that utilizes a separate steel pin or molded-in plastic pin/tab for clearing excess or dried glue from a glue dispenser and FIG. 2 provides a somewhat simplified illustration of a glue bottle of the kind typically used with the closures of the present invention. In FIG. 2, a closure or cap 200 has been threaded on to a flexible, squeezable, or otherwise semi-collapsible bottle 100 that is intended for use with water-based glues, adhesives, or the like.

Figure 3:
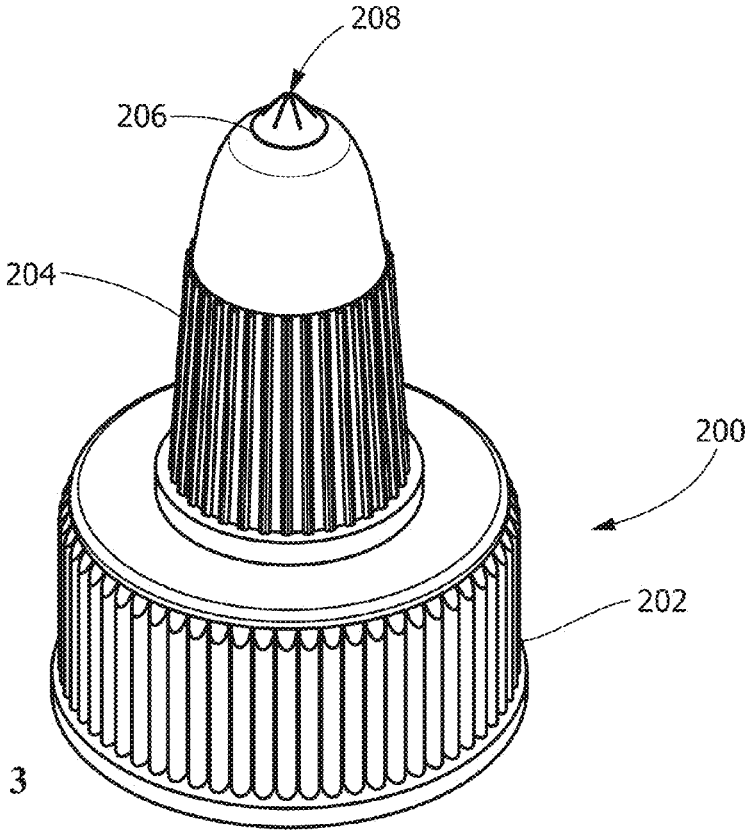
FIG. 3 is perspective view of a first exemplary embodiment of the closure of the present invention.
Figure 4:
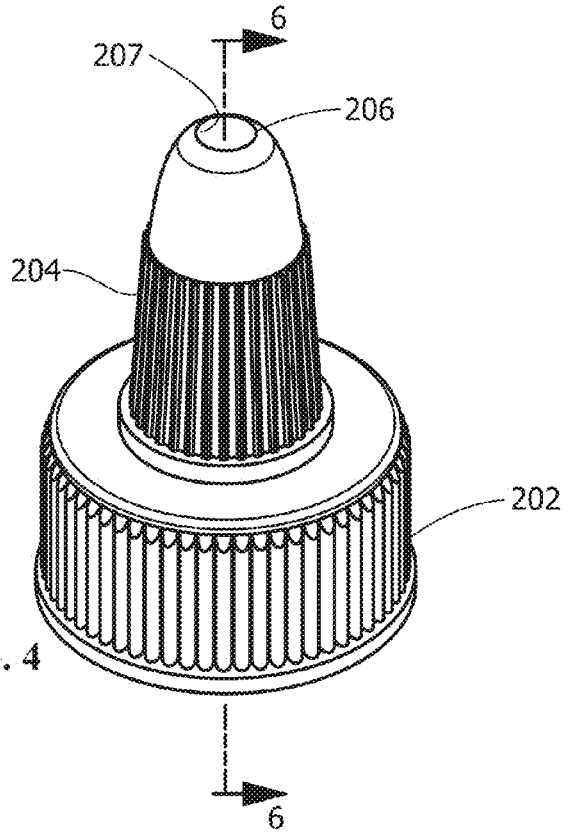
FIG. 4 is a perspective view of the closure of FIG. 3, wherein the insert or liner component has been removed.
Figure 5:
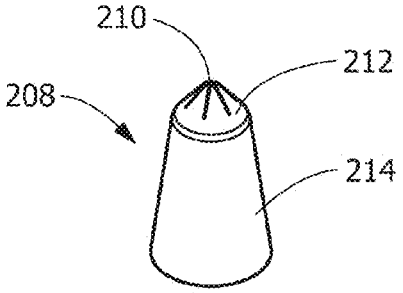
FIG. 5 is a perspective view of the insert or liner component of the closure of FIG. 3 showing the placement of the one-way valve therein.
Figure 6:
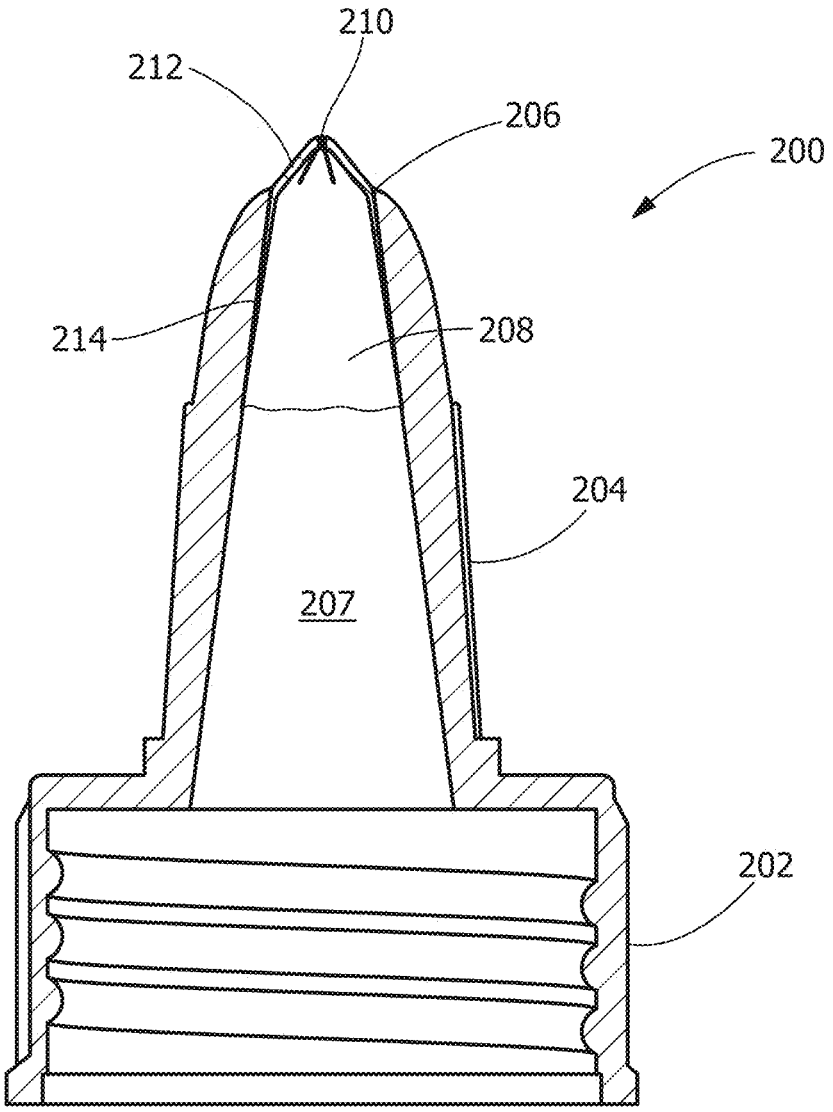
FIG. 6 is a side cutaway view of the closure of FIG. 3, illustrating the placement of the insert component within the fluid passage or channel of the twistable cap portion of the closure assembly.

With reference to FIGS. 2-6, a first exemplary embodiment of the present invention includes bottle closure assembly 200, which is adapted to be attached to bottle 100. Bottle closure assembly 200 further includes threaded lower portion or base 202, which is positioned beneath upper closure portion 204, which is rounded or substantially domed-shaped. Substantially circular aperture 206 is formed in the topmost tapered section of upper closure portion 204 and provides access to fluid passage 207, which is a substantially conical passageway (see FIG. 6) that extends lengthwise through closure assembly 200. Insert 208, which may also be referred to as a liner or a sleeve is disposed within fluid passage 207 and, in the embodiment shown in FIG. 3-5, is mechanically fitted into aperture 206. As shown in FIG. 6, insert 208 may also be molded onto the interior surface of fluid passage 207 through a secondary over molding process during the molding of upper portion of closure 204. Insert 208 further includes one-way valve 210, which is formed in the topmost conical section of insert 208 and which, in this embodiment, is a star-shaped or starburst-shaped valve that includes a plurality slits that divide the valve into triangular projections that rest against one another to form a seal. Collar portion 212, which is formed around the opening of one-way valve 210 extends upward and out of aperture 206, while tapered body portion 214 extends downward and into fluid passage 207. When not in use, one-way valve 210 is biased to a closed state or position, which is adapted to reversibly open in response to a positive pressure from within bottle 100. Insert 208 typically includes at least one hydrophobic material such as, for example, silicone. After the use of bottle 100, there may be excess glue or adhesive remaining on the inside of fluid passage 207. If this excess glue or adhesive contains water, then the excess material will naturally move away from the hydrophobic material and drain back into bottle 100 when the bottle is placed in a vertical orientation for storage. Draining excess glue or adhesive from the tip of upper portion of closure 204 reduces the clogging that would be likely to occur in the excess material remained in fluid passageway 207.

Figure 7:
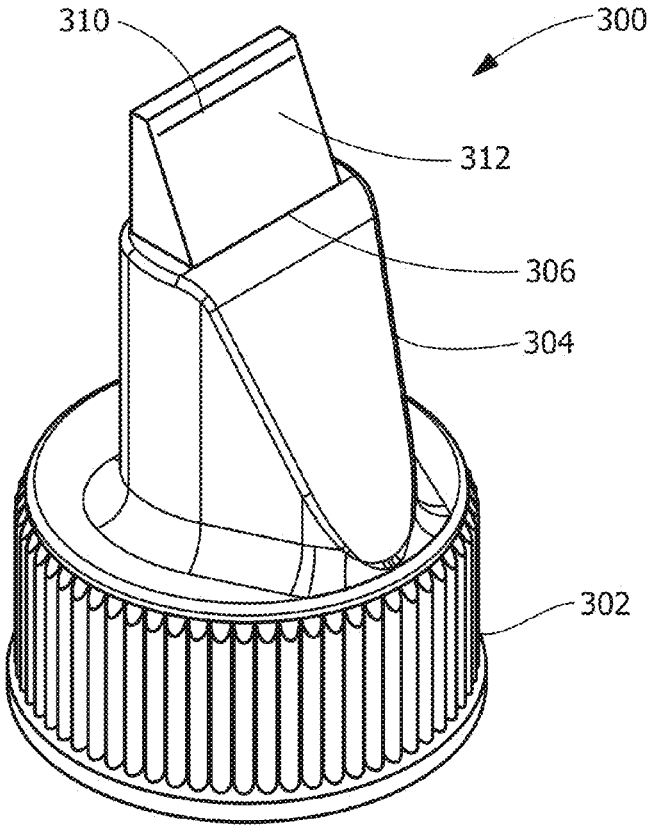
FIG. 7 is perspective view of a second exemplary embodiment of the closure of the present invention.
Figure 8:
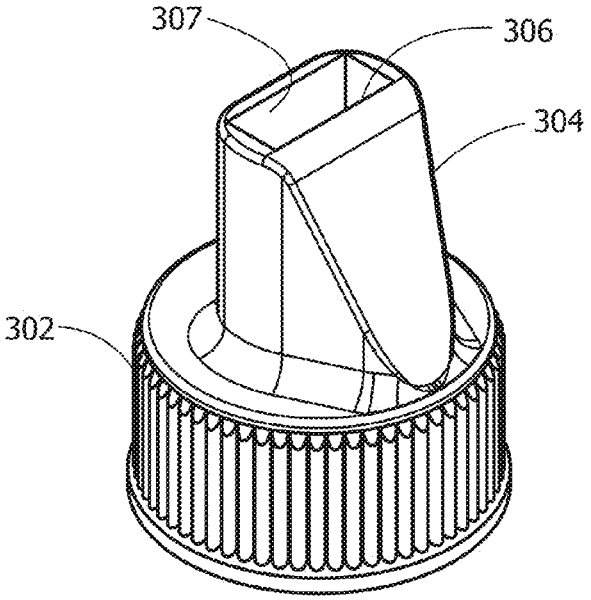
FIG. 8 is a perspective view of the closure of FIG. 7, wherein the insert or liner component has been removed.
Figure 9:
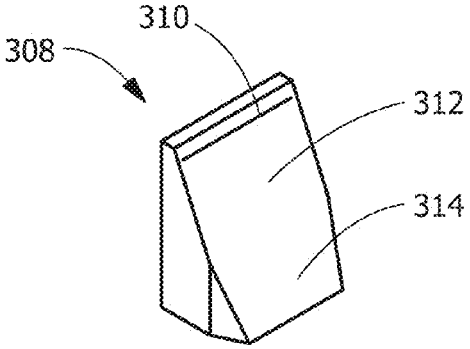
FIG. 9 is a perspective view of the insert or liner component of the closure of FIG. 7 showing the placement of the one-way valve therein.

With reference to FIGS. 7-9, a second exemplary embodiment of the present invention includes bottle closure assembly 300, which is adapted to be attached to bottle 100. Bottle closure assembly 300 further includes threaded lower portion or base 302, which is positioned beneath upper closure portion 304, which is substantially wedge-shaped. Substantially rectangular aperture 206 is formed in the topmost tapered section of upper closure portion 304 and provides access to fluid passage 307, which is a substantially rectangular passageway that extends lengthwise through closure assembly 300. Insert 308, which may also be referred to as a liner or a sleeve is disposed within fluid passage 307 and, in the embodiment shown in FIG. 7-9 is mechanically fitted into aperture 306. Insert 308 may also be molded onto the interior surface of fluid passage 307 through a secondary over molding process during the molding of upper portion of closure 304. Insert 308 further includes one-way valve 310, which is formed in the topmost section of insert 308 and which, in this embodiment, is configured as a sort of duckbill valve that includes a single slit, the sides of which form a seal. Collar portion 312, which is formed around the opening of one-way valve 310 extends upward and out of aperture 306, while tapered body portion 314 extends downward and into fluid passage 307. When not in use, one-way valve 310 is biased to a closed state or position, which is adapted to reversibly open in response to a positive pressure from within bottle 100. Insert 308 typically includes at least one hydrophobic material such as, for example, silicone. After the use of bottle 100, there may be excess glue or adhesive remaining on the inside of fluid passage 307. If this excess glue or adhesive contains water, then the excess material will naturally move away from the hydrophobic material and drain back into bottle 100 when the bottle is placed in a vertical orientation for storage. Draining excess glue or adhesive from the tip of upper portion of closure 304 reduces the clogging that would be likely to occur in the excess material remained in fluid passageway 307.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A closure for a container comprising:

a cap comprising a base portion adapted to be attached to a container that is adapted to store water-based glue, an upper closure portion defining an aperture at a topmost section thereof and defining a substantially conical fluid passage for dispensing glue from the container, the substantially conical fluid passage extending between the aperture and the base portion of the cap; and an insert disposed at least partially within the aperture of the upper closure portion of the cap, wherein the insert is formed of at least one hydrophobic material and comprises (i) a self-sealing one-way valve for dispensing glue from the container when pressure is applied to the exterior of the container and for preventing backflow of the glue into the cap when the pressure is released, and (ii) a substantially conical sleeve portion disposed in the fluid passage of the cap, wherein the at least one hydrophobic material is operative to encourage the water-based glue to flow back into the container after the pressure has been released and when the container is stored in a vertical position.

2. The closure of claim 1, wherein a tip of the upper closure portion of the cap is substantially dome-shaped.

3. The closure of claim 1, wherein the insert is mechanically fitted into the aperture of the upper closure portion of the cap.

4. The closure of claim 1, wherein the insert is molded integrally onto an internal surface of the fluid passage of the upper closure portion of the cap.

5. The closure of claim 1, wherein one-way valve comprises a starburst-shaped opening for dispensing glue from the container.

6. The closure of claim 1, wherein one-way valve comprises a single slit for dispensing glue from the container.

7. The closure of claim 1, wherein the at least one hydrophobic material is silicone.

8. The closure of claim 1, wherein the substantially conical sleeve portion is sized such that at least a portion of an internal surface of the fluid passage is configured to contact glue being dispensed from the container.

9. A closure for a container, comprising:

a cap comprising a base portion adapted to be attached to a container that is adapted to store water-based glue, an upper closure portion defining an aperture at a topmost section thereof and defining a substantially wedge-shaped fluid passage for dispensing glue from the container, the substantially wedge-shaped fluid passage extending between the aperture and the base portion of the cap; and an insert disposed at least partially within the aperture of the upper closure portion of the cap, wherein the insert is formed of at least one hydrophobic material and comprises (i) a self-sealing one-way valve for dispensing glue from the container when pressure is applied to the exterior of the container and preventing backflow of the glue into the cap when the pressure is released, and (ii) a tapered sleeve portion disposed in the fluid passage of the cap, wherein the at least one hydrophobic material is operative to encourage the water-based glue to flow back into the container after the pressure has been released and when the container is stored in a vertical position.

10. The closure of claim 9, wherein the aperture of the upper closure portion is substantially rectangular.

11. The closure of claim 9, wherein the insert is either mechanically fitted into the aperture of the upper closure portion of the cap or molded integrally onto an internal surface of the fluid passage of the upper closure portion of the cap.

12. The closure of claim 9, wherein the insert is substantially wedge-shaped.

13. The closure of claim 9, wherein the one-way valve comprises a duckbill valve having a single slit for dispensing glue from the container.

14. The closure of claim 9, wherein the at least one hydrophobic material is silicone.

15. The closure of claim 9, wherein the tapered sleeve portion is sized such that at least a portion of an internal surface of the fluid passage is configured to contact glue being dispensed from the container.

16. A closure for a container, comprising:

a cap comprising a base portion adapted to be attached to a container that, is adapted to store water-based glue, and an upper closure portion defining a fluid passage for dispensing glue from the container;

a self-sealing one-way valve disposed at a topmost section of the upper closure portion, the self-sealing one-way valve being configured for dispensing glue from the container when pressure is applied to the exterior of the container; and at least one hydrophobic material applied onto a portion of an internal surface of the fluid passage between the self-sealing one-way valve and the base portion of the cap and/or onto an internal surface of the self-sealing one-way valve, wherein the hydrophobic material is operative to encourage the water-based glue to flow back into the container after the pressure has been released and when the container is stored in a vertical position.

17. The closure of claim 16, wherein the fluid passage of the upper closure portion of the cap is either substantially conical or substantially wedge-shaped.

18. The closure of claim 16, wherein the valve is either substantially dome-shaped or substantially wedge-shaped.

19. The closure of claim 16, wherein the valve comprises either a starburst-shaped opening for dispensing glue from the bottle or a single slit for dispensing glue from the bottle.

20. The closure of claim 16, wherein the at least one hydrophobic material is applied onto the internal surface of the fluid passage between the self-sealing one-way valve and the base portion of the cap, such that at least a portion of the internal surface of the fluid passage is configured to contact glue being dispensed from the container.

* * * * *